United States Patent [19]

McCullough et al.

[11] Patent Number: 4,892,469

[45] Date of Patent: Jan. 9, 1990

[54] COMPACT SCROLL-TYPE FLUID COMPRESSOR WITH SWING-LINK DRIVING MEANS

[75] Inventors: John E. McCullough, Carlisle; John T. Dieckmann, Belmont; Thomas P. Hosmer, Concord, all of Mass.

[73] Assignee: Arthur D. Little, Inc., Cambridge, Mass.

[21] Appl. No.: 250,730

[22] Filed: Apr. 3, 1981

[51] Int. Cl.[4] ..... F04C 18/04; F04C 29/02

[52] U.S. Cl. ..... 418/55; 418/57; 418/98; 418/151; 418/DIG. 1

[58] Field of Search ..... 418/55, 57, 97–100, 418/142, 144, 151, DIG. 1

[56] References Cited

U.S. PATENT DOCUMENTS

| | | | |
|---|---|---|---|
| 1,906,142 | 4/1933 | Ekelof | 418/59 |
| 3,802,809 | 4/1974 | Vulliez | 418/55 |
| 3,924,977 | 12/1975 | McCullough | 418/55 |
| 3,986,799 | 10/1976 | McCullough | 418/55 |
| 3,994,636 | 11/1976 | McCullough et al. | 418/55 |
| 4,065,279 | 12/1977 | McCullough | 418/55 |
| 4,259,043 | 3/1981 | Hidden et al. | 418/55 |
| 4,303,379 | 12/1981 | Hiraga et al. | 418/55 |
| 4,304,535 | 12/1981 | Terauchi | 418/55 |
| 4,314,796 | 2/1982 | Terauchi | 418/55 |

FOREIGN PATENT DOCUMENTS

| | | | |
|---|---|---|---|
| 12614 | 6/1980 | European Pat. Off. | 418/55 |
| 12616 | 6/1980 | European Pat. Off. | 418/55 |
| 109793 | 8/1980 | Japan | 418/55 |
| 486192 | 5/1938 | United Kingdom | 418/57 |

*Primary Examiner*—John J. Vrablik

*Attorney, Agent, or Firm*—Bacon & Thomas

[57] ABSTRACT

A compact scroll compressor capable of maintaining a high efficiency when driven at variable speeds and operating at variable gas pressures. The compressor incorporates a unique swing-link driving means and means to control the flow of high-pressure fluid from the central high-pressure zone defined by the scroll members. The compressor is particularly suited for operation off an automotive engine to provide compressed refrigerant in an automotive air conditioner.

8 Claims, 6 Drawing Sheets

COMPACT SCROLL-TYPE FLUID COMPRESSOR WITH SWING-LINK DRIVING MEANS

This invention relates to a scroll-type, positive displacement, fluid compressor and more particularly to a compact, highly efficient compressor especially suited as an automotive refrigerant compressor.

There is known in the art a class of devices generally referred to as "scroll" pumps, compressors and engines wherein two interfitting spiroidal or involute spiral elements of like pitch are mounted on separate end plates forming what may be termed stationary and orbiting scroll members. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent to Creux (U.S. Pat. No. 801,182) describes this general type of device. Among subsequent patents which have disclosed scroll compressors and pumps are U.S. Pat. Nos. 2,475,247, 2,494,100, 2,841,089, 3,011,694, 3,560,119, 3,600,114, 3,802,809, and 3,817,664, British Patent No. 486,192 and French Patent No. 813,559. Recent developments in scroll technology have been directed to a number of different aspects and improvements which have resulted in the construction of scroll machines capable of approaching or attaining their real potential. These improvements have been concerned with sealing (both radial and tangential), axial load controlling and driving (U.S. Pat. Nos. 3,884,599, 3,924,977, 3,994,633, 3,994,636, 4,065,279, 4,082,484, 4,192,152 and 4,199,308); with the porting and operation of liquid pumps (U.S. Pat. Nos. 4,129,405 and 4,160,629); with couplings (U.S. Pat. Nos. 4,121,438 and 4,259,043); and with cooling (U.S. Pat. No. 3,986,799).

Scroll apparatus embodying one or more of these improvements have found a number of applications including, but not limited to, relatively large compressors, liquid pumps or varying sizes, and expansion engines. Because of the advantages inherent in scroll apparatus, e.g., high efficiency, the possibility of minimizing noise and vibration, the ability to handle a wide range of fluids including gases which may contain dispersed liquid droplets, and the like, scroll machines offer a good potential as compressors for automotive refrigerant compressors. However, this application for scroll apparatus places several stringent requirements on them which are normally not present in most other uses. Thus a compressor for an automotive air conditioner must be compact and at the same time it must maintain maximum efficiency while operating at variable speeds with variable gas pressure.

It is therefore a primary object of this invention to provide improved positive fluid displacement scroll apparatus, and in particular scroll compressors especially suited for use in automotive air conditioners. It is another object of this invention to provide scroll compressors of the character described which are compact and highly efficient and which operate with minimum noise and vibration. A further object is to provide a novel compressor for automotive air conditioners which can be readily fit into different automotive designs and easily integrated with different automotive engines. Still another object of this invention is to provide a scroll compressor which is capable of maintaining maximum efficiency while operating at variable speeds with variable gas pressures thus achieving an overall reduction in power input required to compress the refrigerant used.

Other objects of the invention will in part be obvious and will in part be apparent hereinafter.

The invention accordingly comprises the features of construction, combinations of elements, and arrangement of parts which will be exemplified in the constructions hereinafter set forth, and the scope of the invention will be indicated in the claims.

According to one aspect of this invention there is provided a positive fluid displacement compressor into which fluid is introduced at low pressure through a peripheral inlet port for circulation therethrough and subsequently withdrawn at high pressure through a central discharge port, and comprising a stationary scroll member having an end plate and an involute wrap of multiple turns and an orbiting scroll member having an end plate and an involute wrap of multiple turns affixed to the inner surface thereof, driving means for orbiting the orbiting scroll member with respect to the stationary scroll member whereby the involute wraps make moving line contacts to seal off and define moving pockets of variable volumes of different fluid pressures on both sides of the moving line contact, and coupling means to maintain the scroll members in fixed angular relationship and tangential force-applying means, characterized in that the driving means comprises, in combination, drive shaft means; crankplate means affixed to the drive shaft means; swing-link means pivotally connected to the crankplate means, arranged to pivot about a pivot point and rotatably connected to the orbiting scroll member, the pivot point being located on a line drawn radially outward from the centerline of the orbiting scroll member and forming an angle with a line drawn tangentially to the orbit radius of the orbiting scroll member, whereby the magnitude of the angle determines the magnitude of force with which the line contacts are made; counterweight means forming a component of the swing-link means to balance the centrifugal force on the orbiting scroll member; and bearing means arranged to carry the moments on the crankshaft as it rotates to effect the orbiting of the orbiting scroll member.

According to another aspect of this invention there is provided a positive fluid displacement compressor comprising, in combination, a stationary scroll member having an end plate and an involute wrap of multiple turns affixed to the inner side thereof; an orbiting scroll member having an end plate and an involute wrap of multiple turns affixed to the inner side thereof; driving means for orbiting the orbiting scroll member whereby the involute wraps make moving line contacts to seal off and define moving pockets of variable volume and zones of different fluid pressure on both sides of the moving line contact, the driving means comprising drive shaft means; crankshaft means affixed to the drive shaft means; swing-link means pivotally connected to the crankplate means, arranged to pivot about a pivot point and rotatably connected to the orbiting scroll member, the pivot point being located on a line drawn radially outward from the centerline of the orbiting scroll member and forming an angle with a line drawn tangentially to the orbit radius of the orbiting scroll member whereby the magnitude of the angle determines the magnitude of force with which the line contacts are made; counterweight means forming a component of the swing-link means to balance the centrifugal force on the orbiting scroll member; and bearing means arranged to carry the moments on the crankshaft as it rotates to effect the orbiting of the orbiting scroll member; axial force-carrying means; coupling means to maintain the scroll members in fixed angular relationship; and housing means defining with the scroll members low-pressure fluid inlet means and high-pressure fluid discharge means.

For a fuller understanding of the nature and objects of the invention, reference should be had to the following detailed description in connection with the accompanying drawings in which FIG. 1 is a longitudinal cross section of a compressor constructed in accordance with this invention;

Figure 6:
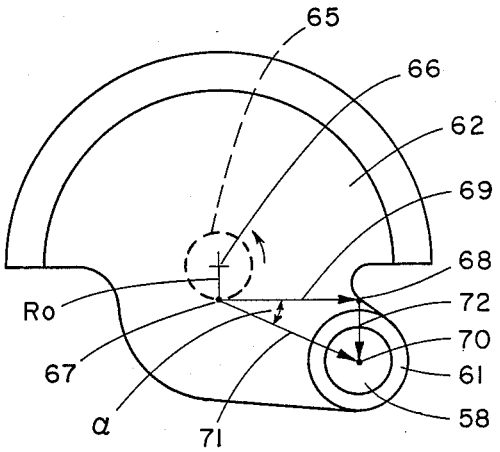
Figure 7:
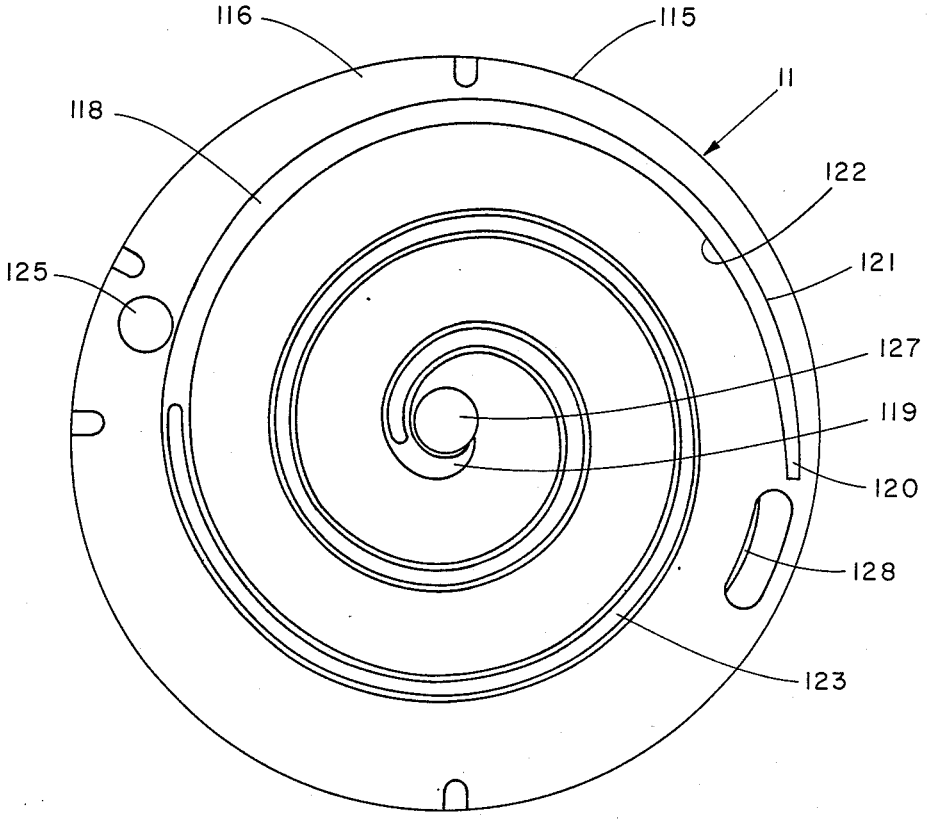
Figure 9:
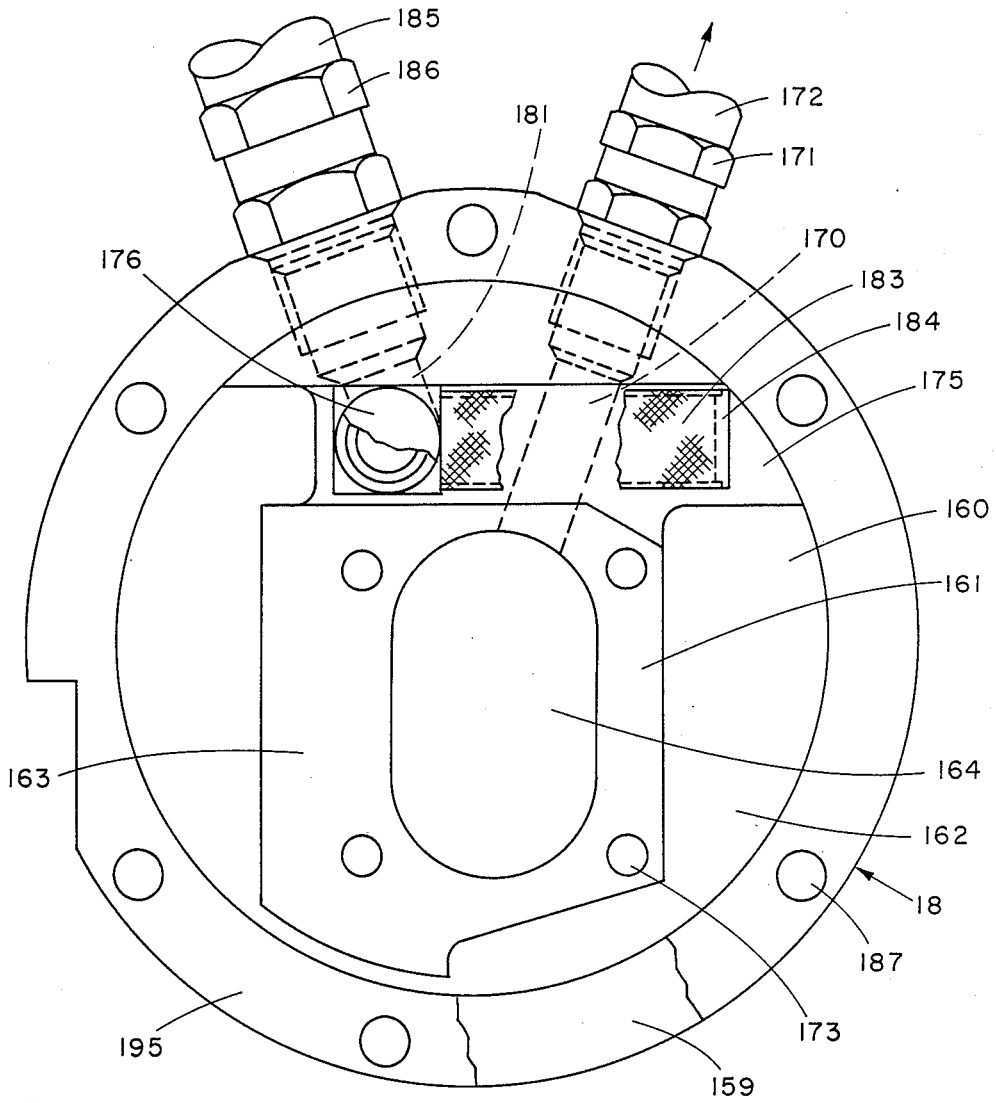
Figure 8:
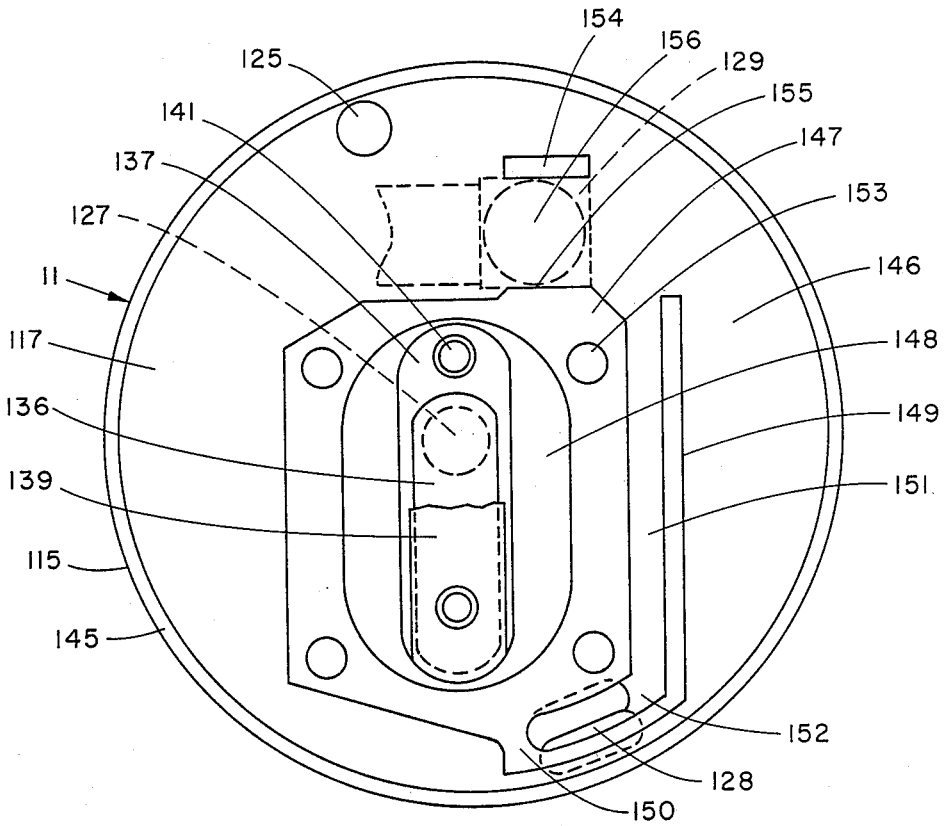
Figure 10:
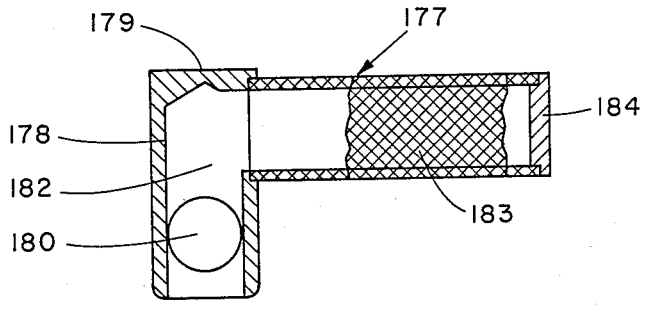

FIG. 6 diagrams to unique design of the swing link driving means;

FIG. 7 is a planar view of the inner side of the stationary scroll member showing the stationary wrap and sealing member channel cut in the wrap surface;

FIG. 8 is a planar view of the outer side of the stationary scroll member showing the block defining a cavity and an oil flow passage and the high-pressure check valve;

FIG. 9 is a planar view of the inner side of the cover showing the block defining a complementary cavity and the positioning of the oil separator; and FIG. 10 is a side elevational view, partly in cross section, of the oil separator.

Figure 1:
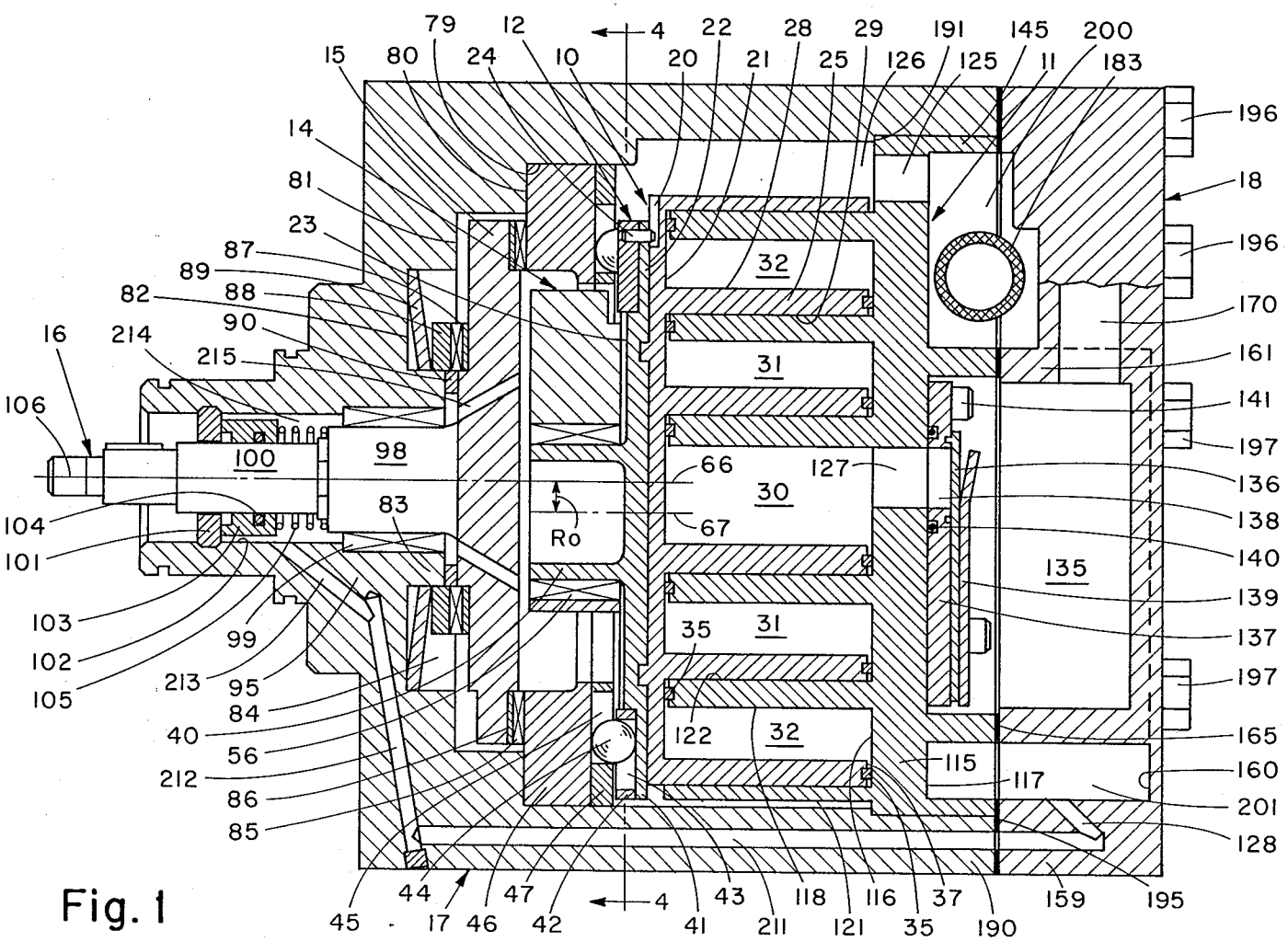
Figure 2:
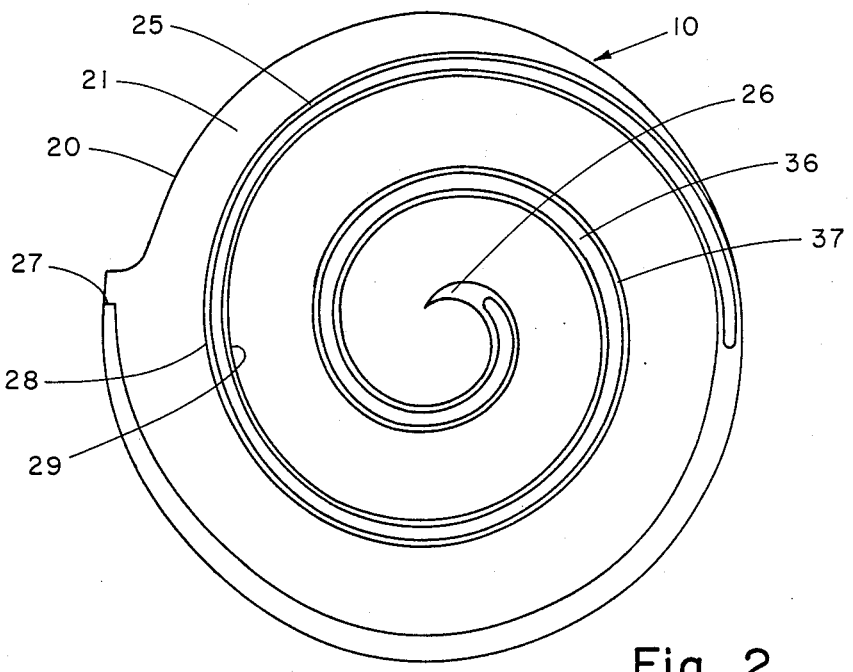
FIG. 2 is a planar view of the inner side of the orbiting scroll member showing the orbiting wrap and sealing member channel cut in the wrap surface.

As shown in FIG. 1, the compressor of this invention comprises an orbiting scroll member, generally indicated by the reference numeral 10, a stationary scroll member 11, an axial load-carrying/coupling component 12, driving means including a swing-link mechanism 14, crankplate 15, crank shaft 16, casing 17 and cover 18. In the following description, the orbiting scroll member 10, its driving means and means coupling it to the casing will be detailed first with reference to FIGS. 1–6.

Orbiting scroll member 10 comprises an end plate 20 with an inner surface 21 and having attached to its outer surface a support plate 22, the surface 23 of which in effect serves as the outer surface of end plate 20. Support plate 22 is keyed to end plate 20 and positioned by pin 24. Affixed to or integral with inner surface 21 is an involute wrap 25, extending from inboard end 26 through some two and three quarters turns to outboard end 27. As will be seen from FIG. 2, the outer flank 28 of wrap 25 through something over one-half of its last turn is configured so that wrap 25 is gradually reduced in thickness as it approaches outboard end 27. This wrap configuration and its positioning relative to end plate 20 is one of the features which contributes to the attaining of a compact scroll compressor.

Radial sealing between fluid pockets 30, 31 and 32 (FIG. 1) must be accomplished by effecting sealing contact between a sealing surface associated with the end surfaces of the scroll wraps and the inner surface of the end plate of the complementary scroll member. In accordance with the teachings of U.S. Pat. Nos. 3,994,636 and 4,199,308 and of U.S. Ser. No. 233,915 filed Feb. 12, 1981, and assigned to the same assignee as the present case, all of which are incorporated herein by reference, radial sealing is accomplished through the use of axially compliant tip seals comprising a sealing member 35 (FIG. 1) seated in a channel 36 cut in end surface 37 of the wrap. As detailed in the above-cited patents and application, but not shown specifically in FIGS. 1 or 2, sealing member 35 is free to undergo small axial and radial excursions in channel 36 and has associated with it an axially directed actuating means to force it into sealing contact with the surface of the complementary end plate. Due to the decreasing thickness of involute wrap 25 and to the fact that radial sealing is not as important along that portion of the wrap represented by the last half outboard turn of wrap 25, channel 36 and sealing member 35 are terminated at essentially that point in wrap 25 where it begins to taper down to minimum thickness.

Figure 3:
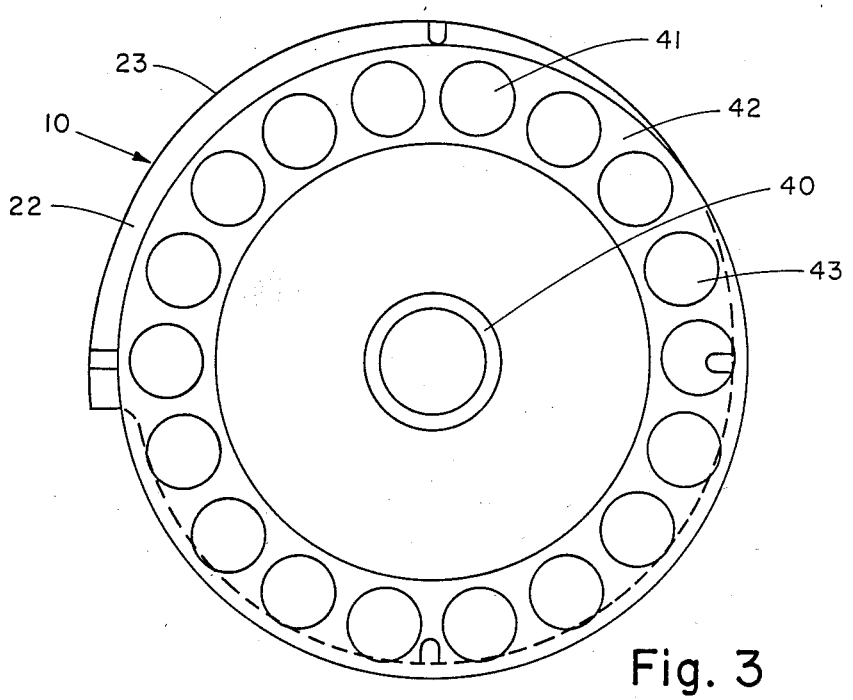
FIG. 3 is a planar view of the outer side of the orbiting scroll member showing that portion of the coupling means which is affixed thereto.

FIG. 3 is a planar view of the outer surface of support plate 22, i.e., equivalent to the outer surface of the end plate of the orbiting scroll member 10. As will be seen from FIGS. 1 and 3, this scroll member is provided with a stub shaft 40 which is preferably formed integrally with support plate 22. Stub shaft 40 is connected to a swing link as detailed below, and with an element of the axial load-carrying/coupling component. This element comprises an annular orbiting ball plate 41 to which is affixed an annular orbiting ball ring 42 having cut therethrough a plurality of uniformly spaced holes which, when assembled with plate 41 define a plurality of circular indentations 43, in each of which a sphere 44 can undergo a continuous rotary motion when confined between indentations 43 and complementary indentations 45 associated with thrust plate 46 which is affixed by means (not shown) to casing 17. As will be seen in FIGS. 1 and 4, indentations 45 are formed in fixed ball ring 47 by drilling a plurality of holes therethrough and affixing ring 47 to the surface of thrust plate 46.

In accordance with the teaching of U.S. Pat. No. 4,259,043, there is thus provided a single axial load-carrying/coupling component, the orbiting scroll member being coupled to the casing 17 to maintain it in a fixed angular relationship with stationary scroll member 11 which is also affixed to casing 17. In addition, this axial load-carrying/coupling component 12 carries the axial loads placed upon the orbiting scroll member as it is rotated by the mechanism described below. The manner in which the design parameters for this component, e.g., size of indentations 43 and 45, diameter of spheres 44 and orbit radius $R_o$, are determined is detailed in U.S. Pat. No. 4,259,043 which is incorporated herein by reference.

As noted previously, the driving means comprise swing-link means 14, crankplate 15 and crankshaft means 16. As the orbiting scroll member of a scroll apparatus is driven to orbit with respect to the stationary scroll member, the fluid pockets are in part defined by moving line contacts between the flanks of the wrap members. The maintenance of such line contacts achieves what may be termed tangential sealing. It will be appreciated that efficient tangential sealing must be attained with minimal wear, given a precisely constructed scroll member. This is preferably accomplished through the use of compliant mechanical linking means which make it possible to maintain a predetermined radial force acting upon the orbiting scroll through the pulling action of the link on the orbiting scroll member. The swing-link mechanism described in U.S. Pat. No. 3,924,977 is such a means and it is used herein in a uniquely modified form.

Figure 4:
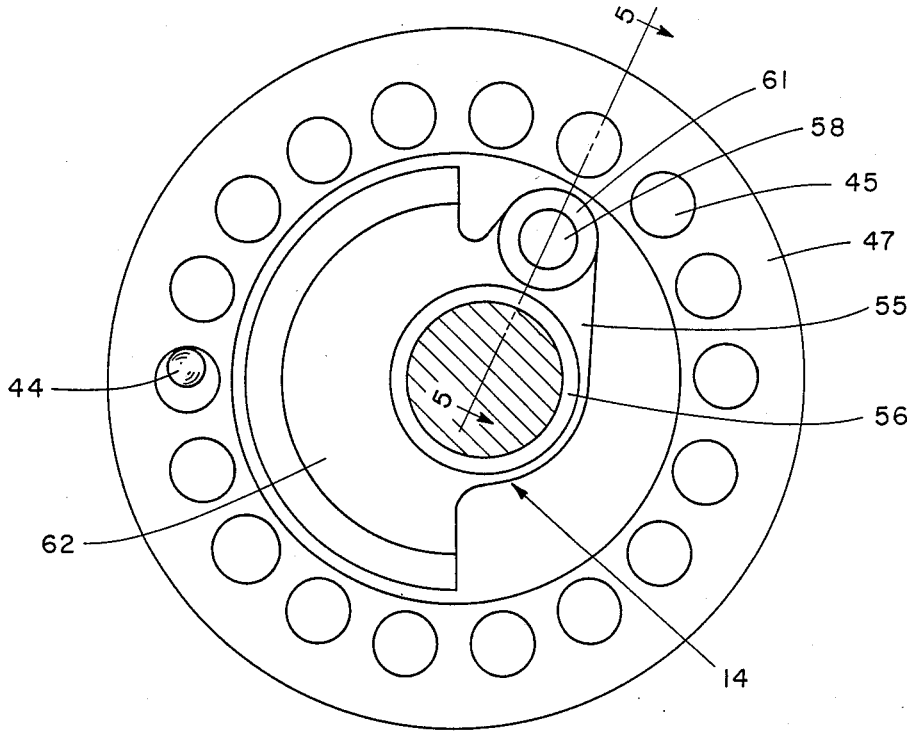
FIG. 4 is a transverse cross section of the compressor of FIG. 1 taken through plane 4—4 of FIG. 1, omitting the coupling ring attached to the orbiting scroll end plates and showing the swing-link driving means.
Figure 5:
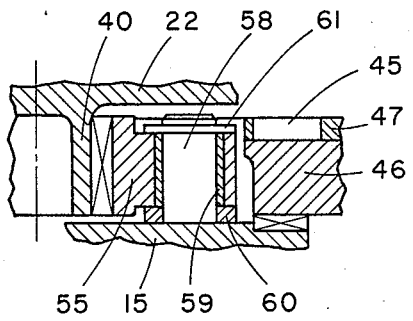
FIG. 5 is a cross section through plane 5—5 of FIG. 4 showing the attachment of the swing-link to the crankplate.

As will be seen from FIGS. 4 and 5, the swing-link, generally indicated by reference numeral 14, comprises a link component 55 rotatably mounted between stub shaft 40, (through roller bearing 56 held in inner ring 57) and pivot pin 58 affixed to crank plate 15. Link 55 is mounted on pivot pin 58 through a liner 59 resting on a spacer 60 and maintained in place by retaining ring 61. A counterweight 62 is affixed to or integral with link component 55.

A comparison between the swing-link system of FIGS. 4 and 5 with that FIG. 19 of U.S. Pat. No. 3,924,977 will show two major differences, i.e., the location of the pivot point and the use of counterweight 62. These differences may be detailed more fully with reference to FIG. 6. The orbit path 65 of the orbiting scroll member is, of course, defined by the orbit radius $R_o$, the distance between the machine axis 66, i.e., the centerline of the stationary scroll member, and the centerline 67 of the orbiting scroll member. In previously designed swing-links, the pivot point 68, i.e., axis of the pivot pin, has been located on a tangent 69 to the orbit radius or on the side of the tangent line towards the direction of rotation, as shown in U.S. Pat. No. 3,924,977 (FIG. 20). However, as will be seen in FIG. 6, the pivot point 70 of pin 58 has been moved out on a line 71 which defines an angle $\alpha$ with tangent 69 whereby the pivot point 70 is located on that side of tangent line 69 that is opposite the direction of motion of orbiting scroll member 10. Since force is a vector it can be divided into components, one acting along line 69 tangential to orbit radius $R_o$ and other acting along line 71 radially outward, which means that the force that actually brings the flanks of the involute wraps of the two scroll members into line contact is that represented by vector line 72. The magnitude of angle $\alpha$ is based upon the amount of flank contact force desired and it will be apparent that the flank or radial contact force will be proportional to the driving force between the crankplate 15 and the orbiting scroll member 10. Counterweight 62 is sized to exactly balance the centrifugal force on orbiting scroll member 10 so that flank contact force is not influenced by operating speed.

The swing-link modification used in the compressor of this invention makes possible the attainment of maximum efficiency by a scroll apparatus which must operate at variable speeds with variable gas pressures. In the case of an automotive air conditioner, the compressor is run off a variable speed machine—automobile engine—and has a variable pressure acting across it. In order to attain a consistently high efficiency under these conditions it is necessary to be able to regulate the contact forces between the involute flanks to minimize power consumption. If the pivot point were on the tangent, i.e., were at point 68 in FIG. 6, there would be insufficient force to hold the flanks together thus creating leakage problems. The swing-link system of this invention eliminates gas leakage due to insufficient flank contact force s well as excess power consumption due to centrifugal loading.

Returning to FIG. 1, it will be seen that the inner wall 79 of casing 17 is formed to have an inwardly directed series of shoulders 80, 81 and 82 and to have between the levels of shoulders 81 and 82 an internally shouldered annular bearing housing ring 83 defining with shoulder 82 an annular well 84. Thrust plate 46 contacts inner wall 79 and is bolted to shoulder 80 by means not shown. Inasmuch as the orbiting of orbiting scroll member 10, through the rotation of crankplate 15, develops moments which act upon that crankplate member, it is necessary in the driving means used to provide means for carrying such moments. In the compressor of FIG. 1 the means to carry these moments comprise in combination thrust bearing 85 contacting thrust plate 79 and acting upon crankplate 15 through thrust washer 86; and thrust bearing 87 acting on crankplate 15 by virtue of the axial force applied to it through thrust washer 88 by Belleville washer 89 seated in well 84.

Casing 17 terminates in an annular stepped crank shaft housing 95. That crankshaft section 98 attached to crankplate 15 is supported and aligned in roller bearing 99 which is seated in bearing housing ring 83, and crankshaft section 100 has associated with it a fluid seal comprising a ring 101 seated in the internal wall 102 of housing 95, a sliding member 103, sealed to crankshaft section 100 through an o-ring 104 and urged into sealing contact with ring 101 by compressive spring 105. Crankshaft 16 terminates external of housing 95 in a terminal section 106 suitable for connection with a motor or other driving means not shown.

The design of crankplate 15, its relation to thrust plate 46, and the use of the thrust bearings and the Belleville washer in the arrangement shown make possible the attainment of a very compact machine suitable for fitting into many different automotive engine systems.

Alternatively, Belleville washer 89 can be replaced with a solid annular spacer ring of the correct thickness to provide adequate axial preload of bearings 85 and 87. This technique may entail greater manufacturing cost but it will reduce friction in bearings 85 and 87 and thereby improve the overall operating efficiency.

The stationary scroll member 11 is shown in FIGS. 7 and 8, FIG. 7 being a planar view of the inside and FIG. 8 of the outside of this component. Stationary scroll member 11 comprises an end plate 115 having an inner surface 116 and an outer surface 117. Affixed to or integral with inner surface 116 is an involute wrap 118 extending from inboard end 119 through some two and three-quarters turns to outboard end 120. As in the case of the orbiting scroll involute wrap, the outer flank 121 of wrap 118 is configured so that the wrap is gradually reduced in thickness as it approaches outboard end 120. A sealing member 35 is seated in channel 123 cut in end surface 124 of wrap 118 as described above in connection with the orbiting scroll member 10. Cut through end plate 115 are low-pressure fluid inlet passage 125 which communicate with peripheral fluid pocket 126 of the compressor (FIG. 1), and high-pressure fluid discharge passage 127.

As will be seen from FIGS. 1 and 8, flow direction of the finally compressed high-pressure fluid from inner pocket 30 through passage 127 into exhaust manifold 135 is controlled by a check valve, e.g., a reed valve 136 which is affixed through valve plate 137, having passage 138, to outer surface 117 of end plate 115. The reed valve assembly, including valve support 139 and an o-ring 140 encircling passage 138, is bolted to end plate 115 through bolts 141. The use of a check valve to control the flow direction of compressed fluid into manifold 135 makes it possible to reduce the power input required to compress the fluid. This is a preferable arrangement since the limitations placed on the size of the scroll machine do not make it possible to construct the compressor with the optimum volume ratio.

Integral with or affixed to the periphery of outer surface 117 of end plate 115 is a wall member 145, providing a closed-in area 146 and defining with cover 18 a fluid volume which is compartmentalized as hereinafter described. Within area 146 is a block 147 also preferably formed integrally with outer surface 117 of end plate 115. As will be seen in FIG. 8 this block 147 is machined with a central cavity 148 in which the reed valve assembly is located. Block 147 has attached thereto a wall member 149 joined to the block at 150 and generally following its configuration along one side to define with the block side wall a gas passage 151 closed at the point of joining. Drilled into block 147 are a plurality of threaded holes 153. There is also affixed to surface 117 an oil separator retaining wall 154 which, with wall section 155 of block 147, defines a passage 156 into which the head of an oil separator is positioned and held as dotted in.

Cover 18 is shown in FIGS. 1 and 9, the latter being a planar view of the inner side 160. A block 161, corresponding is basic configuration to block 147 when cover 18 is affixed to casing 17 and stationary scroll member 11 is provided in the area 162 defined within the peripheral wall 159 of the cover. Block 161, rather than having a wall member corresponding to 149 of block 147 is solid throughout its section 163 thereby providing a cover for gas passage 151. A central cavity 164 in block 161 corresponds to cavity 148 of block 147 and when blocks 161 and 147 are joined through an appropriately shaped gasket 165 (FIG. 1) they form the fluid-tight exhaust manifold 135. High-pressure fluid is delivered through discharge passage 170 to which are attached external coupling means 171 for making connection to a compressed fluid line 172. Block 161 has clearance holes 173 corresponding in position to holes 153 in block 147.

From FIGS. 1 and 9 it will be seen that there is provided integral with block 161 an oil separator platform 175 through which there is cut a circular passage 176 to accommodate oil filter 177 insofar that passage 176 is sized to engage the filter stem 178, having cap 179, (See FIG. 10). Oil separator stem 178 is seated in passage 176 such that opening 180 in stem 178 is aligned with low-pressure fluid return passage 181. The oil-containing, low-pressure fluid is forced through the passage 182 in separator stem 178 into the filter which comprises a cylindrical screen member 183 closed with cap 184. The oil entrained in the recycled low-pressure fluid, brought in through low-pressure line 185 connected to fluid return passage 181 through coupling 186, tends to collect and coalesce on screen 183 to form oil droplets.

Peripheral wall 159 of cover 18 has cut through it a plurality of clearance holes 187 and correspondingly positioned threaded holes are cut into the wall 190 of casing 17. The compressor is assembled by setting stationary scroll member 11 into casing 17 to rest against an inwardly directed annular shoulder 191 cut into the internal wall of casing 17 at a level such that the surface of peripheral wall 145 of the scroll member is flush with the surface of casing wall 190 to allow wall 159 of cover 18 to make a fluid-tight seal, through gasket 195, with the stationary scroll member and the casing. This assembly is accomplished through the use of screws 196 (FIG. 1) running through cover 18 into casing 17 and screws 197 running through cover 18 and holes 173 into threaded holes 153 in end plate 115 of stationary scroll member 11.

With this assembly there are defined between the stationary scroll member and the cover an upper low-pressure manifold 200 and an oil sump 201 into which oil droplets, collected on separator screen surface 183, are directed around the inner periphery of stationary scroll member 14 and cover 18 to the drainage passage 128. Branching off from oil inlet passage 128 are communicating oil supply passages 211, 212 and 213 which are drilled in casing 17. Oil flows through this series of passages into the fluid-tight chamber 214 defined in crankshaft housing 95, around roller bearings 99, then through a plurality of passages 215 in crankplate 15, into contact with the bearings of swing-link assembly 14 and the axial load-carrying/coupling component 12 and finally into the scroll pumping chambers. Oil volume in the compressed fluid discharged through passage 170 is usually less than 3 percent. Oil returning from the air conditioning system is separated out, as explained above, in oil separator 177.

The scroll compressor of this invention is unique in that it exhibits a high performance over a range of speeds and gas pressures, is in perfect dynamic balance and is essentially noiseless and vibration free while being extremely compact and light-weight. It is particularly suited for incorporation in automotive air-conditioners.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

We claim:

1. In a positive fluid displacement compressor into which fluid is introduced at low-pressure through a peripheral inlet for circulation and subsequently withdrawn at high pressure through a central discharge port, the compressor comprising a housing, stationary and orbiting scroll members each having an end plate and an involute wrap of multiple turns interengaged and cooperating with each other within the housing; drive shaft means extending through the housing and rotatable about a drive shaft axis for driving said orbiting scroll member in a circular orbit with respect to said stationary scroll member about an orbital axis, the orbit having an orbit radius define as the distance between the centerline of the stationary scroll member and the centerline of the orbiting scroll member, whereby said involute wraps make moving line contacts to seal off and define moving pockets of variable volumes of different fluid pressures on both sides of said moving line contact; coupling means to maintain said scroll members in fixed angular relationship; the improvement comprising:

(a) crankplate means affixed to said drive shaft means and rotatable about the drive shaft axis;

(b) swing-link means pivotally connected to said crankplate means in torque transmitting relationship and pivotally movable relative to said crankplate means about a pivot point offset from said drive shaft axis; said pivot point following a circular orbital path about said drive shaft axis; said swing-link means extending from said pivot point and being pivotally connected to said orbiting scroll member in driving relationship to pull the orbiting scroll member in its orbital path in the same direction as the crankplate means; said pivot point of said swing-link means being located towards one side of a tangent line extending from the orbit radius of the orbiting scroll member where the centerline of the orbiting scroll member is located, and generally towards the pivot point, said one side being away from the direction of motion of said orbiting scroll member; counterweight means forming a component of said swing-link means connected to said orbiting scroll member and having a mass that generates a centripetal force with respect to the orbital axis that exactly balances the centrifugal force exerted by the orbiting scroll member and its associated structure when said orbiting member is driven about its orbital axis so that driving motion of said crankplate means through said swing-link means effects orbital movement of the orbiting scroll member and the sole radial sealing force between the wraps of the orbiting scroll member and the stationary scroll member, said sealing force being proportional to driving torque applied to the orbiting scroll member by said crankplate means;

(c) a fixed thrust plate means disposed between said crankplate means and said orbiting scroll member, said thrust plate means having a surface facing towards said crankplate means;

(d) a bearing means arranged to react and carry moment loads generated by the driving force applied by the crankplate means to the orbiting scroll member, said bearing means comprising a first thrust bearing between said crankplate means and said thrust plate surface and a second thrust bearing means on the opposite side of said crankplate means; and (e) means for exerting an axial force against the second thrust bearing means in a direction to urge the crankplate means against the first thrust bearing means.

2. The improvement in a compressor according to claim 1, said axial force applying means comprising a spring means.

3. The improvement in a compressor according to claim 2, said spring means comprising a Belleville washer.

4. The improvement in a compressor according to claim 1, wherein said fixed plate means comprises a portion of said coupling means, and said fixed plate means is arranged to react axial thrust loads of said orbiting scroll member into the compressor housing.

5. The improvement in a compressor according to claim 4, wherein said orbiting scroll member includes an outer side facing towards said plate means; a plurality of first circular spaced recesses or openings in said outer face; a plurality of second circular spaced recesses or openings associated with said plate means, said first and second circular spaced recesses or openings facing towards each other, with the centers of all said recesses or openings being located on circles having the same radii; and an axial load carrying rolling sphere disposed within each facing pair of said recesses or openings, said sphere spanning the distance between said outer side of said orbiting scroll member and said thrust plate; the relative diameters of each sphere and of said recesses or openings being such as to accommodate said orbit radius while maintaining a predetermined angular relationship between said scroll members; whereby said plate means reacts axial thrust loads from said orbiting scroll member into the compressor housing.

6. In a positive fluid displacement compressor into which fluid is introduced at low-pressure through a peripheral inlet for circulation and subsequently withdrawn at high pressure through a central discharge port, the compressor comprising a housing, stationary and orbiting scroll members each having an end plate and an involute wrap of multiple turns interengaged and cooperating with each other within the housing; drive shaft means extending through the housing and rotatable about a drive shaft axis for driving said orbiting scroll member in a circular orbit with respect to said stationary scroll member about an orbital axis, the orbit having an orbit radius defined as the distance between the centerline of the stationary scroll member and the centerline of the orbiting scroll member, whereby said involute wraps make moving line contacts to seal off and define moving pockets of variable volumes of different fluid pressures on both sides of said moving line contact; coupling means to maintain said scroll members in fixed angular relationship; the improvement comprising:

(a) crankplate means affixed to said drive shaft means and rotatable about the drive shaft axis;

(b) swing-link means pivotally connected to said crankplate means in torque transmitting relationship and pivotally movable relative to said crankplate means about a pivot point offset from said drive shaft axis; said pivot point following a circular orbital path about said drive shaft axis: said swing-link means extending from said pivot point and being pivotally connected to said orbiting scroll member in driving relationship to pull the orbiting scroll member in its orbital path in the same direction as the crankplate means; said pivot point of said swing-link means being located towards one side of a tangent line extending from the orbit radius of the orbiting scroll member where the centerline of the orbiting scroll member is located, and generally towards the pivot point, said one side being away from the direction of motion of said orbiting scroll member; counterweight means forming a component of said swing-link means connected to said orbiting scroll member and having a mass that generates a centripetal force with respect to the orbital axis that exactly balances the centrifugal force exerted by the orbiting scroll member and its associated structure when said orbiting member is driven about its orbital axis so that driving motion of said crankplate means through said swing-link means effects orbital movement of the orbiting scroll member and the sole radial sealing force between the wraps of the orbiting scroll member and the stationary scroll member, said sealing force being proportional to driving torque applied to the orbiting scroll member by said crankplate means;

(c) a low-pressure fluid inlet into the housing in communication with said peripheral inlet;
(d) a sump within the housing;
(e) a low pressure manifold between said low pressure inlet and said peripheral inlet, said low pressure manifold in communication with said sump;
(f) fluid conduit means between said sump and the area of the housing adjacent said drive shaft and crankplate means;
(g) a tubular oil coalescer screen means closed at one end disposed in said low pressure manifold, said coalescer screen means having an interior;
(h) said low pressure fluid inlet in communication with said interior so that all low pressure inlet fluid is directed to the interior of the coalescer screen means and is caused to flow through said coalescer screen as it approaches said scroll members;
whereby oil in the low pressure inlet stream is coalesced and caused to drop to the sump to provide a source of lubrication for said drive shaft and crankplate area.

7. The improvement in a compressor according to claim 6, including a high pressure fluid discharge manifold located adjacent said central discharge port and a high pressure fluid outlet in communication with said high pressure discharge manifold, said high pressure manifold defined by juxtaposed portions of said housing, one portion comprising a cover plate including means for connecting said high and low pressure manifolds with external fluid conduit means; and a reed-type check valve disposed between said central discharge port and said high pressure manifold, said reed valve preventing reverse flow of high pressure fluid from said high pressure fluid outlet into said discharge port; said reed valve being secured to said end plate of said stationary scroll member.

8. In a positive fluid displacement compressor into which fluid is introduced at low-pressure through a peripheral inlet for circulation and subsequently withdrawn at high pressure through a central discharge port, the compressor comprising a housing, stationary and orbiting scroll members each having an end plate and an involute wrap of multiple turns interengaged and cooperating with each other within the housing; drive shaft means extending through the housing and rotatable about a drive shaft axis for driving said orbiting scroll member in a circular orbit with respect to said stationary scroll member an orbital axis, the orbit having an orbit radius defined as the distance between the centerline of the stationary scroll member and the centerline of the orbiting scroll member, whereby said involute wraps make moving line contacts to seal off and define moving pockets of variable volumes of different fluid pressures on both sides of said moving line contact; coupling means to maintain said scroll members in fixed angular relationship; the improvement comprising:
(a) crankplate means affixed to said drive shaft means and rotatable about the drive shaft axis;
(b) swing-link means pivotally connected to said crankplate means in torque transmitting relationship and pivotally movable relative to said crankplate means about a pivot point offset from said drive shaft axis; said pivot point following a circular orbital path about said drive shaft axis; said swing-link means extending from said pivot point and being pivotally connected to said orbiting scroll member in driving relationship to pull the orbiting scroll member in its orbital path in the same direction as the crankplate means; said pivot point of said swing-link means being located towards one side of a tangent line extending from the orbit radius of the orbiting scroll member where the centerline of the orbiting scroll member is located, and generally towards the pivot point, said one side being away from the direction of motion of said orbiting scroll member; counterweight means forming a component of said swing-link means connected to said orbiting scroll member and having a mass that generates a centripetal force with respect to the orbital axis that exactly balances the centrifugal force exerted by the orbiting scroll member and its associated structure when said orbiting member is driven about its orbital axis so that driving motion of said crankplate means through said swing-link means effects orbital movement of the orbiting scroll member and the sole radial sealing force between the wraps of the orbiting scroll member and the stationary scroll member, said sealing force being proportional to driving torque applied to the orbiting scroll member be said crankplate means;
(c) a high pressure fluid discharge manifold located adjacent said central discharge port;
(d) a high pressure fluid outlet in communication with said high pressure discharge manifold;
(e) a reed-type check valve disposed between said central discharge port and said high pressure manifold, said reed valve preventing reverse flow of high pressure fluid from said high pressure fluid outlet into said discharge port, said reed valve being secured to said end plate of said stationary scroll member.

* * * * *